United States Patent [19]

Bradley et al.

[11] B 3,999,695

[45] Dec. 28, 1976

[54] FILAMENT BREAKAGE DETECTION AND CORRECTION

[75] Inventors: Walter Eugene Bradley, Fort Mill, S.C.; Raeford Warren Clontz, Charlotte, N.C.; Terry Stephen Floyd, Matthews, N.C.; James Reed Honeycutt, Charlotte, N.C.

[73] Assignee: Celanese Corporation, New York, N.Y.

[22] Filed: Sept. 16, 1974

[21] Appl. No.: 506,624

[44] Published under the second Trial Voluntary Protest Program on March 9, 1976 as document No. B 506,624.

Related U.S. Application Data

[62] Division of Ser. No. 413,109, Nov. 5, 1973, Pat. No. 3,857,309.

[52] U.S. Cl. ..... 226/1; 226/11; 226/12; 226/45; 226/91; 226/112; 19/.25

[51] Int. Cl.[2] ..... B65H 25/04

[58] Field of Search ..... 200/61.18; 19/.25, .26; 226/1, 11, 12, 45, 91, 112; 139/351; 28/50

[56] References Cited

UNITED STATES PATENTS

| | | | |
|---|---|---|---|
| 2,675,988 | 4/1954 | Fife | 226/45 X |
| 3,584,358 | 6/1971 | Harris | 28/50 |
| 3,665,844 | 5/1972 | Clark | 226/11 |
| 3,792,821 | 2/1974 | Fallon | 226/11 X |

*Primary Examiner*—Richard A. Schacher
*Attorney, Agent, or Firm*—Pamela D. Kasa; Roderick B. Macleod

[57] ABSTRACT

The present invention relates to: process and apparatus for feeding continuous filaments to a continuous multifilament structure utilizing tangentially converging fluid streams to forward the filaments; process and apparatus for detecting breakage of filaments utilizing a rotatable cylinder, or a gap in a three dimensional body, wherein breakage of the filament causes a measurable change in the pressure of fluid flowing to the cylinder or the gap; process and apparatus for the production of continuous multifilament structures wherein, upon breakage of a continuous filament, the breakage detector automatically activates a filament feeder to temporarily insert a substitute filament.

9 Claims, 9 Drawing Figures

FIG. 1
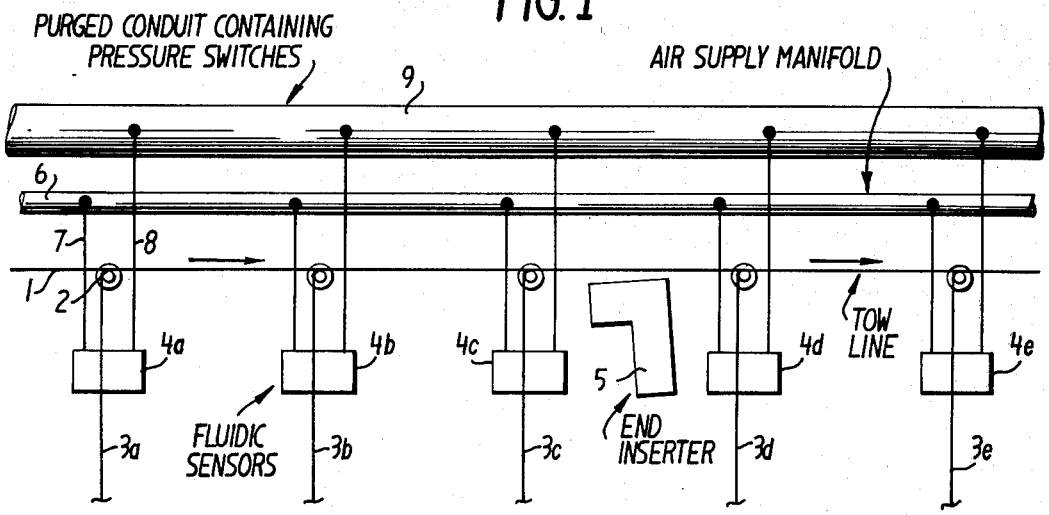
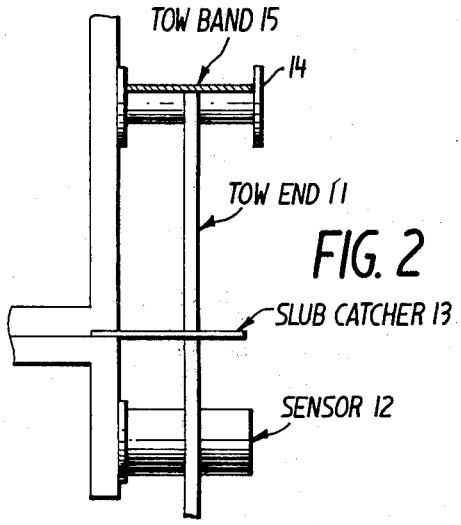
FIG. 2
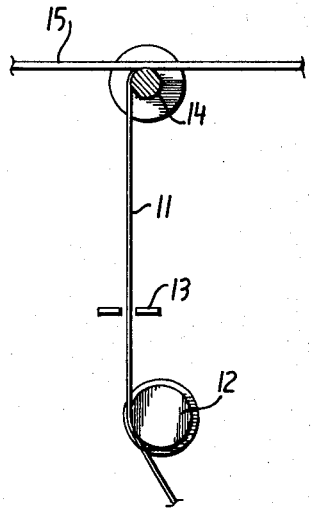
FIG. 3
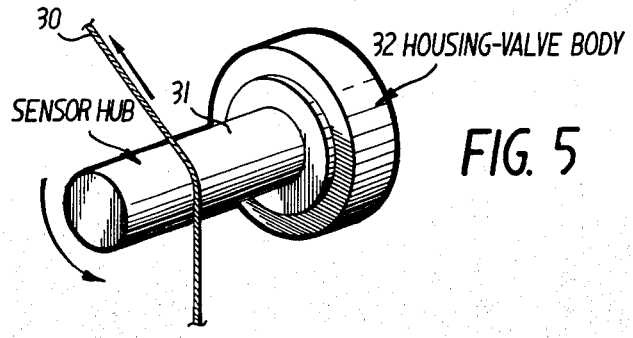
FIG. 5

FILAMENT BREAKAGE DETECTION AND CORRECTION

This is a division, of application Ser. No. 413,109 filed Nov. 5, 1973 now U.S. Pat. No. 3,857,309.

BACKGROUND OF THE INVENTION

Man-made fibers are often supplied as tows, which are bundles of generally parallel continuous filaments, each such bundle containing a large number of such filaments, generally well over 500, e.g. 6,000 to 500,000. In the manufacture of tows, sub-tows may be formed by joining together a plurality of continuous filaments. A number of sub-tows, each containing only a fraction of the filaments desired in the main tow, are usually fed side-by-side to a draw frame where they are stretched, in a manner well known in the art, to develop the desired physical properties (e.g. high tenacity and stiffness). The sub-tows are then combined and the resulting tow is fed to a crimping device, which is preferably of the stuffer box type, where the filaments are crimped, and then, in an untensioned condition, onto a belt which transfers the crimped tow continuously through an oven maintained at a temperature sufficiently high to permanently set the crimp, but not high enough to damage or melt the filaments.

The draw frame, crimping device and oven are utilized most efficiently when the tow passing therethrough contains a very large number of filaments, e.g. two whose total denier is over about 50,000 and which contains over about 10,000 filaments. However, for certain end uses the crimped, heat set tow may be lower or higher in weight or filament count. For example, in the production of cigarette filters from tow, the number of filaments may be as low as 5,000 and the total denier as low as 35,000.

Cigarette filters may be formed from such crimped continuous filament tows. Upon being received by the filter manufacturer, the tow is opened and the crimps of the filaments deregistered, utilizing a process such as that disclosed in U.S. Pat. No. 3,156,016 to Dunlap et al. The tow is fed along a predetermined path and is subjected to a differential gripping action between a plurality of points spaced from one another both longitudinally and transversely of the path, so that certain laterally spaced sections of the tow are positively gripped relative to other laterally spaced sections of the tow, alternating with the gripped sections, which are not gripped at all or are gripped at different relative points. In this manner there is produced, as a function of the differential positive gripping of the tow, a relative shifting of adjacent filaments longitudinally of the tow, whereby the crimps are moved out of registry with one another.

The deregistered tow is then fed through a chamber in which a plasticizer is applied to the tow. The tow is thereafter treated to reduce its cross-sectional area until it is approximately equal to the cross-sectional area of a cigarette. The condensed mass is formed into a coherent structure, e.g. by wrapping paper around it and/or by curing, and is ultimately cut into suitable plug lengths for incorporation into cigarettes.

It has been found that the filters produced are not all identical as far as filtering action is concerned. The filters differ somewhat in weight, in filtering efficiency and in their resistance to gas flow therethrough. After smoking, some filters show a degree of uneven darkening, which indicates a somewhat non-uniform passage of smoke therethrough. The more darkened areas identify zones through which the smoke has been preferentially drawn. Tests have shown that a significant cause of these non-uniformities in the cigarette filters result from variations in the total denier and number of ends in the tow. This variation results, to a degree, from undetected broken ends in the tow forming process. Clearly, uniform cigarette filters cannot be produced from a tow which is not substantially uniform.

Therefore, in the manufacture of continuous filament tow, filament breakage is a serious problem. If filament breakage does occur during the production of the tow, the product will have gaps or discontinuities within it which will adversely affect the uniformity of products made from the tow, unless steps are taken to compensate for the broken ends and thereby maintain a uniform number of ends.

Deregistered, opened tows may be utilized for purposes other than cigarette filters. Such tows are especially suitable for the production of nonwoven fibrous sheet-like structures such as may be used as sanitary napkin cover fabrics, pillow stuffing material, filling for sleeping bags or mattress covers, and the like. These products are superior to conventional nonwovens in their freedom from loose fiber ends, in their uniformity (e.g. freedom from thick or thin spots) and strength in the longitudinal direction. Clearly, in order to produce a uniform product, a substantially uniform tow is required.

The continuous feeding of filamentary material is, therefore, critical to the production of substantially uniform tow. Suitable means must be provided for detecting individual breaks in the filaments making up the tow. In addition, the delivery of a continuous strand of filamentary material must be assured. To accomplish this, it is essential that apropriate means be utilized to ensure the feeding of a new filamentary strand or strands to a given tow line upon the breakage of one or more strands of continuous filamentary material.

Certain types of feeding mechanisms are presently available to retain the leading end of a standby supply of filamentary material in readness to be fed to an appropriate feeding mechanism upon the breakage or exhaustion of one or more strands of filamentary material. One such mechanism is disclosed in U.S. Pat. No. 3,128,026 which utilizes electrical means to effect certain shifting arrangements which are utilized to transfer the driving effect of a feeding mechanism from a first strand of filamentary material to a second strand. Another such mechanism is illustrated in U.S. Pat. No. 3,519,181. A mechanism is provided for feeding continuous strandular material, utilizing guide means defining a path and means for forwarding the strandular material along this path. A standby supply of strandular material is provided with a supporting means engaging and positioning its leading end. A control, sensitive to the exhaustion of the first strand, because of the loss of contact therewith, operates to initiate movement of the support means for the first strand to introduce the second strand into engagement with the feed means.

Both of these apparatus require an arrangement for transferring the driving effect of a feed mechanism from the exhausted or broken strandular material to the standby end for insertion into the multifilament strandular material being produced. Of necessity, this results in a certain lag time before the standby end is actually inserted. Under such circumstances, it is clear that a gap can occur in the supplying of an end to the multifilament product, thereby providing for non-uniformity of the final product.

Accordingly, to produce substantially uniform continuous filament tows, it is necessary to provide means for ensuring the continuation of a continuous filamentary material from additional supplies upon the breakage of one or more of the original strands. In order to ensure such a continuous supply of strandular material, the supply means must be immediately warned of the breaking of the strandular material and set into action means for quickly forwarding a new supply of filamentary material to replace the disappearing end of the broken strand.

OBJECTS OF THE INVENTION

It is an object of this invention to provide a system for the detection of filament breakage and replacement of the broken filament.

It is another object of this invention to provide a filament breakage and correction system which will automatically detect and replace broken filaments without any substantial interruption of the supply of filamentary material.

It is yet another object of this invention to provide a filament breakage and correction system utilizing an improved apparatus for inserting replacement filaments.

SUMMARY OF THE INVENTION

In accordance with this invention there is provided a filament break detection and correction system comprising a break detection system and a system for temporarily inserting a substitute end until the original filament end can be reinserted. Alternative break detection systems can be utilized in combination with an end inserter which automatically inserts and removes substitute ends from a multifilament line, such as a tow production line.

The filament end inserter utilizes a jet of fluid, such as air or water, to propel the substitute filament end into a nip point in the tow line. To remove the substitute end, a combination clamp-cutter is energized, which cuts the end and holds it in position for the next filament end insertion.

The end inserter is activated by a sensor which detects the breakage of one or more filament ends. One such device utilizes a fluidic sensing mechanism with the running filament end passing through a gap in the sensor. When a filament end breaks, the gap is opened and a back pressure is created in the gap. The filament end, before breakage, acts as a shield against a fluid, such as air, passing from a high pressure supply through an orifice on one side of the gap to a coaxial orifice positioned on the opposite side of the gap which is in communication with a lower pressure fluid supply. When the filament end breaks, a back pressure occurs at the orifice in communication with the low pressure fluid supply. This back pressure is sensed, such as by a diaphragm which inflates and thereby trips a microswitch which sends an electrical signal to trigger the end inserter to temporarily insert a substitute filament end into the tow line until the broken end can be reinserted. When the malfunction is repaired and the filament end reinserted through the sensor gap, the reduction in back pressure automatically cuts off the end inserter.

In the preferred embodiment, a rotary sensor is utilized for detecting breaks in the continuous running filaments. The sensor detects a running filament end when the filament is passing over a rotatable cylinder. The end of the cylinder is mounted within a housing within which it is freely rotatable. When the running filament is in frictional contact with the cylinder, the cylinder is caused to rotate. The frictional force must be sufficient to overcome the inertial force of the cylinder and a counterweight, spring, magnet or other retaining means holds the cylinder in its inertial position. Because of the rotation of the cylinder through an angle of less than 180°, the retaining means is moved from a position which blocks a fluid orifice, such as an air port, to a position wherein the fluid is free to pass from the orifice. Upon breakage of the running filament end, the frictional contact between the filament end and the rotatable cylinder is terminated and the retaining means and cylinder return to their position of inertia, whereby the retaining means effectively blocks passage of the fluid from the orifice.

The fluid orifice is connected to a source of supply of the fluid and a pressure sensing mechanism. When the flow of the fluid stops, the pressure sensing mechanism detects the build up in pressure which activates another mechanism, such as an electrical microswitch which sends an electrical signal, which triggers the end inserter to temporarily insert a substitute filament end into the tow line until the malfunction can be corrected and the original filament end reinserted. When the malfunction has been corrected and the filament is running in frictional contact with the rotatable cylinder, the cylinder and retaining means are moved from their inertial position back to a position where the retaining means does not block the passage of fluid from the orifice. The reduction in pressure is sensed and the end inserter is automaticaly cut off.

BRIEF DESCRIPTION OF THE DRAWINGS

FIG. 1 is a schematic illustration of a tow producing process utilizing the break detection and correction system of this invention.

FIG. 2 is a front view of an individual filament being fed to the tow line, which shows the passage of the filament end over a sensor for detecting a broken end.

FIG. 3 is a side view of the portion of the tow forming system illustrated in FIG. 2.

FIG. 5 is a plan view of the preferred rotary break detection system utilized in the system of this invention.

DESCRIPTION OF THE PREFERRED EMBODIMENTS

Figure 4:
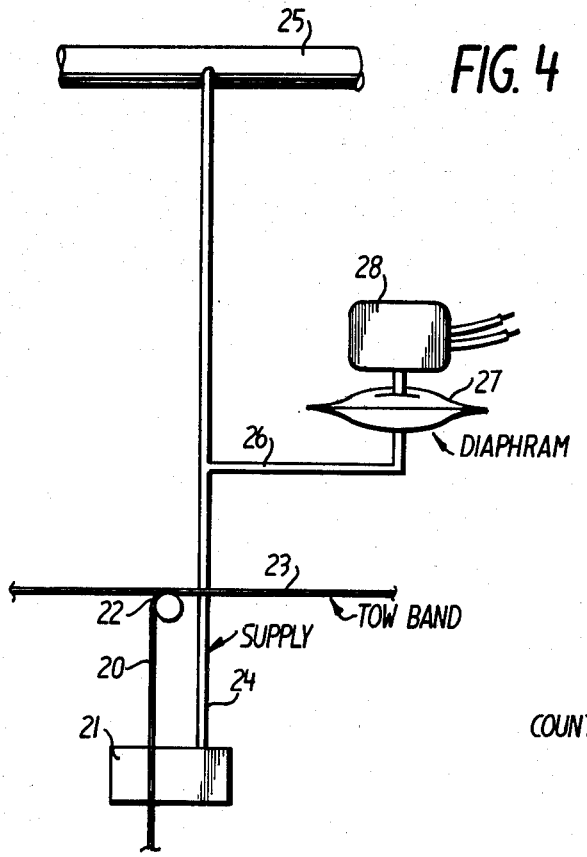
FIG. 4 is a schematic illustration of the break detection system of this invention.

FIG. 1 is a schematic illustration of a tow producing process utilizing the break detection and correction system of this invention. The process shown illustrates five positions — *a*, *b*, *c*, *d*, and *e* — but, for the sake of clarity, the process will be described with regard to the first position only. The tow 1 passes over roll 2 at which point filament 3*a* joins the tow after having passed through break detector or sensor 4*a*. Fluid for the fluidic break detector passes from air supply manifold 6 through conduit 7 to the break detector 4*a*. When an end breaks, the change in pressure is sensed through conduit 8 in purged conduit 9 containing switches or other mechanism sensitive to pressure changes. When a broken filament end is detected by the change in pressure, substitute filament end inserter 5 is activated to temporarily insert a substitute filament until the malfunction is repaired and the original filament reinserted.

FIG. 2 is a front view of an individual filament being fed to the tow line, which shows the passage of the filament over a sensor for detecting a broken end. FIG. 3 is a side view of the tow forming system of FIG. 2. The continuous filament 11 passes over sensor 12 through slub catcher 13 to roll 14 where the filament is joined with and becomes a part of tow band 15.

FIG. 4 is a schematic illustration of the break detection system of this invention. The continuous filament 20 passes over break detector 21 over roll 22 where it joins with the tow band 23 at the nip between the roll and the tow band. A fluid, preferably air, passes from a fluid source 25 through conduit 24, preferably at a flow rate of from about 0.10 to 0.50 SCFM, to filament break detector 21. When a filament breaks, a back pressure is created in the fluid break detector (as will be shown in detail in FIGS. 5, 6, 7 and 9). The back pressure automatically increases the pressure in conduit 24, which increase in pressure is sensed through conduit 26 by a pressure sensing device, such as diaphragm 27. When the diaphragm is inflated, electrical switch 28 is activated. Electrical switch 28 is connected to the filament end inserter, which automatically inserts a substitute filament end. When the malfunction is corrected, the original end is reinserted into the tow band and again passes over the break detector. This eliminates the back pressure sensed by the diaphragm and deactivates the electrical switch, which cuts off the end inserter.

FIG. 5 is a plan view of the preferred break detection mechanism utilized in this invention. The running filament end 30 passes over and is in friction contact with rotatable cylinder 31, the frictional force being sufficient to impart rotation to the cylinder. The cylinder is mounted within a housing 32, in such a manner so as to be freely rotatable therein.

Figure 6:
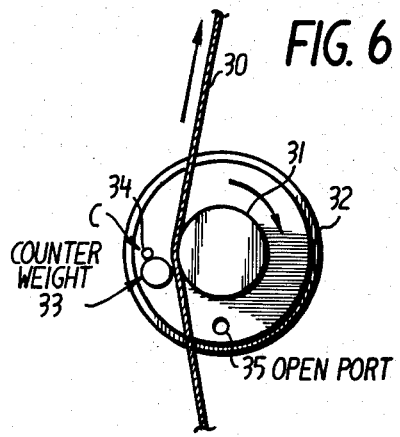
FIG. 6 is a side cross sectional view of the break detector of FIG. 5 showing the filament end in frictional contact with the rotatable cylinder and the fluid orifice open.

FIG. 6 is a side cross sectional view of the break detection device of FIG. 5. The running filament 30 passes over the cylinder 31 in frictional contact therewith to impart rotary motion thereto. A fluid orifice 35, preferably a gas port, is positioned in the stationary housing 32. A retaining means 33, such as a counterweight or magnet, is movably mounted and attached to the rotatable cylinder in such a manner that the frictional force of the running filament is sufficient to overcome the force of inertia of the cylinder and the counterweight attached thereto to rotate the cylinder through an arc of up to 180°, preferably from about 5° to less than 180° (for purposes of illustration the rotation is shown as 90°). When the cylinder is rotated, the counterweight is moved from counterweight storage point 34 (point C), which storage point usually constitutes a small flange.

Figure 7:
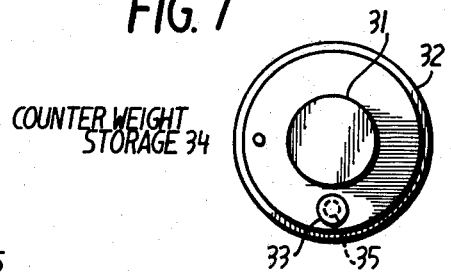
FIG. 7 is a side cross sectional view of the break detector of FIG. 5 showing the rotatable cylinder out of frictional contact with the running filament, the retaining means in its inertial position and the fluid orifice closed.

Upon rotation of the cylinder 31 within the housing 32, the counterweight moves from the counterweight storage at point C to point D, as shown in FIG. 7, where it blocks the fluid orifice 35. This prevents the flow of fluid out of the orifice and builds up pressure in the line through which the fluid passes to the orifice. This increase in pressure is sensed, such as by utilizing the diaphragm and electrical switch illustrated in FIG. 4 and the filament end inserter is activated to temporarily insert a substitute end. Upon repairing of the malfunction, the filament 30 is repositioned in frictional contact with the cylinder 31, which causes the cylinder to rotate and the counterweight to return from position D to position C, thereby reopening the fluid orifice and permitting the flow of fluid therefrom. This returns the pressure in the fluid conduit to normal and deactivates the switch communicating with the filament end inserter to stop feeding the substitute filament and clamp it for future use, as required.

Figure 8:
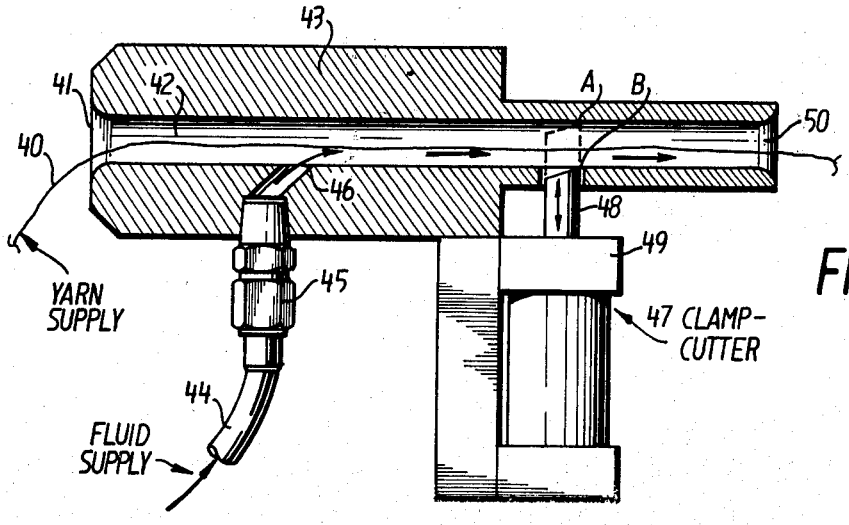
FIG. 8 is a side cross sectional view of the filament end inserter of this invention.

FIG. 8 is a side cross sectional view of the filament end inserter of this invention. The end inserter is generally cylindrical in shape and the substitute filament end 40 passes through the generally circular opening 41 of the generally cylindrical passageway 42 in the body 43 of the substitute end inserter. A fluid under pressure is supplied to conduit 44 and passes through coupling 45 through orifice 46 in the body of the end inserter into the passageway 42. The axis of the conduit ending in orifice 46 forms an angle of from about 1° to 20° with the axis of generally cylindrical passageway 42, preferably the angle ranges from about 3° to 10°. Preferably, a plurality of fluid orifices are utilized for propelling the filament through the passageway of the end inserter. The plurality of orifices are positioned symmetrically around the axis of the passageway, which generally coincides with the path of the filament. When the orifices are so positioned, the fluid streams which flow therefrom will converge at a point downstream of their introduction. The point at which they intersect with each other and with the filament is determined by the exact angle at which they enter the passageway.

Fluid pressures utilized must clearly be sufficient to propel the filament and are generally in the range of from about 15 to 60 pounds per square inch. A combination clampcutter 47 is mounted in orifice 48 in the body of the end inserter in such a manner so as to be freely movable from a position B out of the path of the filament end 40 to a position A whereby it cuts and clamps the filament end. The point of convergence of the fluid streams with each other and with the filament end must be prior to the clamp cutter to provide for adequate propelling of the filament. When the clamp cutter is closed (in position A), the fluid is automatically cut off by any suitable means until reactivation of the inserter.

The clamp-cutter 47 and the body 43 of the end inserter are supported by support means 49. The clamp cutter is connected by suitable means, such as electrically through a microswitch, to the filament breakage detector which activates the clamp-cutter to move from position A to position B upon an end breaking, while simultaneously starting the passage of fluid into the passageway of the inserter. The filament end then passes through outlet orifice 50 to the tow line where it is joined to and becomes a part of the tow band. Upon reinsertion of the original filament end, the end breakage detector activates the clamp-cutter to move to position A and stops the flow of fluid into the inserter, whereby the filament end is cut and clamped for the next insertion required.

Figure 9:
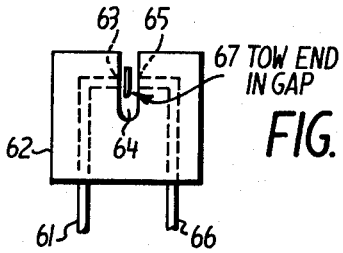
FIG. 9 is a side cross sectional view of a fluid operated break detector.

FIG. 9 is a side cross sectional view of a fluid sensor for detecting the breakage of a filament. A fluid, preferably air pumped at a rate of from about 0.10 to 0.50 SCFM is passed from a fluid supply through conduit 61. The fluid passes out of outlet orifice 63, which preferably has a circular configuration with a diameter of from about 0.004 to 0.015 inch, into gap 64. Another outlet orifice 65 is positioned on the opposite side of gap 64 coaxially aligned with orifice 63. Fluid passes out of orifice 65 at a rate of from about 0.05 to 0.10 SCFM less than the fluid from orifice 63. The lower pressure fluid is passed from a supply thereof through conduit 66, positioned within support body 62, and out of orifice 65 into gap 64. A filament end 67 is passed from a source thereof through gap 64 to the tow line, where it is joined with and becomes a part of the tow band. When the filament end breaks, the gap 64 is then open. Because of the differential in the pressure of the fluid exiting from coaxially aligned orifices 63 and 65, a back pressure is created at orifice 65. This automatically increases the pressure in conduit 66, which increase in pressure is sensed by a pressure sensitive device connected to the end inserter, which automatically inserts a substitute filament end. When the malfunction is corrected, the original filament is reinstated into the gap 64, thus closing the gap. This eliminates the back pressure in conduit 66 and the end inserter is automatically deactivated.

The filament breakage detection and correction system of this invention has been described witth particular regard to a process for the production of continuous filament tow. However, it is clear that the process and apparatus of this invention is equally applicable to processes for the production of other continuous mutlifilament structures, such as tapes, ropes and the like. Such multifilament structures may be formed from any of the fiber-forming materials which can be formed into continuous filaments, e.g. polyethylene terephthalate, other polyesters such as polyesters of terephthalic acid and other glycols, cellulose esters such as cellulose acetate or cellulose triacetate, polyamides such as nylon 6 or nylon 6,6, polyacrylonitriles, poleolefins, etc.

It is to be understoood that the foregoing detailed description is given merely by way of illustration, and that variations may be made therein without departing from the spirit or the scope of this invention.

What we claim is:

1. An apparatus for detecting breakage of a continuous filment, said apparatus comprising: a rotatable cylinder, said cylinder mounted within a housing in such a manner so as to be rotatable therein by means of frictional contact with a running continuous filament; a fluid orifice; a retaining means comprising means for restraining said cylinder in a position causing blocking of said fluid orifice when said cylinder is out of frictional contact with said running filament; a source of supply of fluid and a pressure change detector, said fluid supply and said detector in communication with said orifice; said detector comprising means for detecting changes in pressure caused by the blocking of said orifice when said filament breaks and is out of frictional contact with said cylinder.

2. The apparatus of claim 1 wherein said retaining means is selected from the group consisting of a counterweight and a magnet.

3. The apparatus of claim 1 wherein said retaining means blocks said fluid orifice when said retaining means is in its inertial position.

4. The apparatus of claim 1 wherein the cylinder rotates through an angle of less than 180°.

5. The apparatus of claim 4 wherein the cylinder rotates through an angle of from about 5° to less than 180°.

6. A process for detecting the breakage of a continuous filament, said process comprising: passing a fluid from a source thereof to an orifice; passing a running continuous filament over a rotatable cylinder in frictional contact with said cylinder to rotate said cylinder; simultaneously unblocking the fluid oriifice to allow the passage of fluid therefrom; upon breakage of said continuous filament, returning said cylinder to its original position to block the passage of fluid from said orifice; and sensing the breakage of said continuous filament by detecting the increase in pressure caused by the blockage of said fluid orifice.

7. The process of claim 6 wherein said cylinder is rotated through an angle of less than 180°.

8. The process of claim 7 wherein said cylinder is rotated through an angle of from about 5° to less than 180°.

9. The process of claim 6 wherein the increase in pressure caused by the blockage of said orifice activates an inserter to temporarily insert a substitute filament.

* * * * *